US005498134A

United States Patent [19]

Ibekwe

[11] Patent Number: 5,498,134

[45] Date of Patent: Mar. 12, 1996

[54] HAND-HELD ELECTRIC FAN

[76] Inventor: Sam Ibekwe, 3332 Harrison St., Baker, La. 70714

[21] Appl. No.: 243,329

[22] Filed: May 16, 1994

[51] Int. Cl.[6] ..... F04D 29/18

[52] U.S. Cl. ..... 416/142; 416/247 R

[58] Field of Search ..... 416/142, 143, 416/247 R

[56] References Cited

U.S. PATENT DOCUMENTS

| | | | |
|---|---|---|---|
| Re. 33,286 | 8/1990 | Waters | 2/171.3 |
| 3,788,777 | 1/1974 | Fichter | 417/411 |
| 3,881,198 | 5/1975 | Waters | 2/171.3 |
| 4,141,083 | 2/1979 | Waters | 2/171.3 |
| 4,238,857 | 12/1980 | Waters | 2/171.3 |
| 4,672,968 | 6/1987 | Lenox et al. | 128/380 |
| 4,680,815 | 7/1987 | Hirsch et al. | 2/171.3 |

*Primary Examiner*—John T. Kwon

*Attorney, Agent, or Firm*—H. Dennis Kelly; Timmons & Kelly

[57] ABSTRACT

A cover assembly is attached to a shaft extending upward from a handle. The cover assembly includes a plurality of cross guards that cross in front of and behind the fan blade to prevent injury. A pair of supports hold the cover assembly in an open position, and automatically shut the fan off if the fan is closed.

13 Claims, 3 Drawing Sheets

HAND-HELD ELECTRIC FAN

BACKGROUND OF THE INVENTION

1. Field of the Invention

This invention relates in general to electric fans. In particular, the invention relates to hand-held electric fans.

2. Description of the Prior Art

Electric fans are useful in providing a moving air stream for cooling. Ceiling fans and floor model electric fans are commonly used to cool rooms in lieu of using an expensive air conditioning system.

However, air conditioning units and electric fans are generally not very portable, and sometimes it is necessary to use a hand-held fan. A non-electric hand-held fan can be very simple and inexpensive, but such a fan requires that the fan be manually operated. Using a hand-held fan of this type can be very tiring, since the arm and hand must be kept moving continuously.

Small, hand-held electric fans solve this problem of fatigue. U.S. Pat. No. 3,788,777, issued Jan. 29, 1974, to Fichter, shows a hand-held electric fan. The blades of the Fichter fan are exposed and there is no mechanism for stopping the rotation of the blades when the fan is turned off.

SUMMARY OF THE INVENTION

The general objective of the fan of the present invention is to provide a hand-held electric fan which can move air in a selected direction without exposing the blades of the fan. Another object of the present invention is to provide a portable hand-held fan which is light-weight and collapsible, for easy storage and portability. Another object of the present invention is to provide a hand-held fan in which the rotation of the blades may be dampened and stopped when the fan is collapsed.

These objects are accomplished by a hand-held electric fan having a handle, a shank, a fan blade, and a collapsible cover assembly. The cover assembly surrounds the fan blade and shields the blade.

Also, the fan has a spring-loaded support for supporting the cover assembly in the open position. The spring-loaded support must be closed before the cover assembly can be collapsed. When the spring-loaded support is closed, the support interrupts the electrical supply to the electric motor and shuts off the fan.

As the cover assembly is collapsed, dampers affixed within the cover assembly dampen the blade and bring the blade to a stop. This prevents continued movement of the blade after the fan is shut off, thereby providing the ability to quickly place the fan into its storage position.

DESCRIPTION OF THE PREFERRED EMBODIMENT

Figure 1:
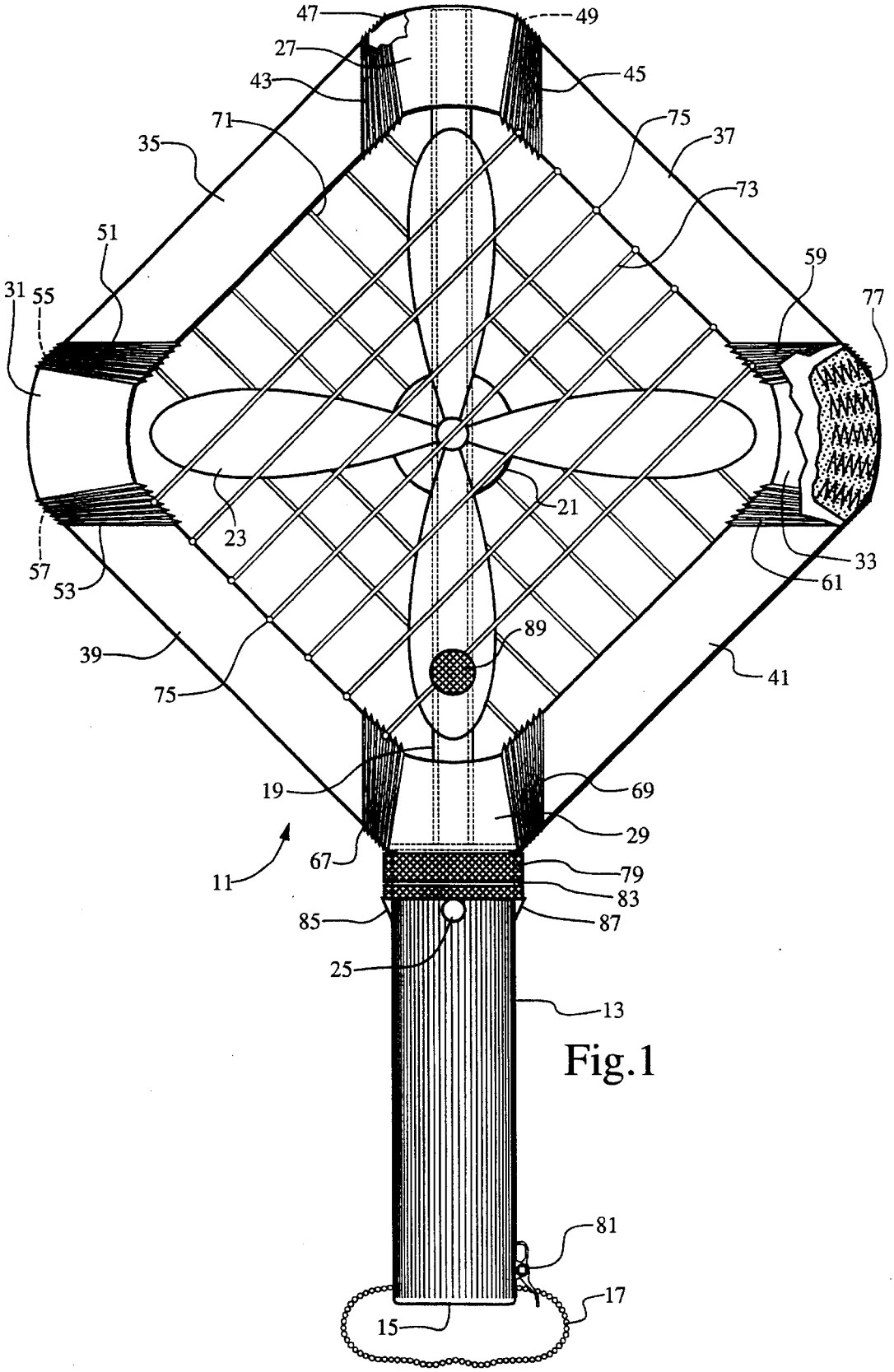
FIG. 1 is a front elevation of a hand-held electric fan according to the invention, shown in the open position.
Figure 2:
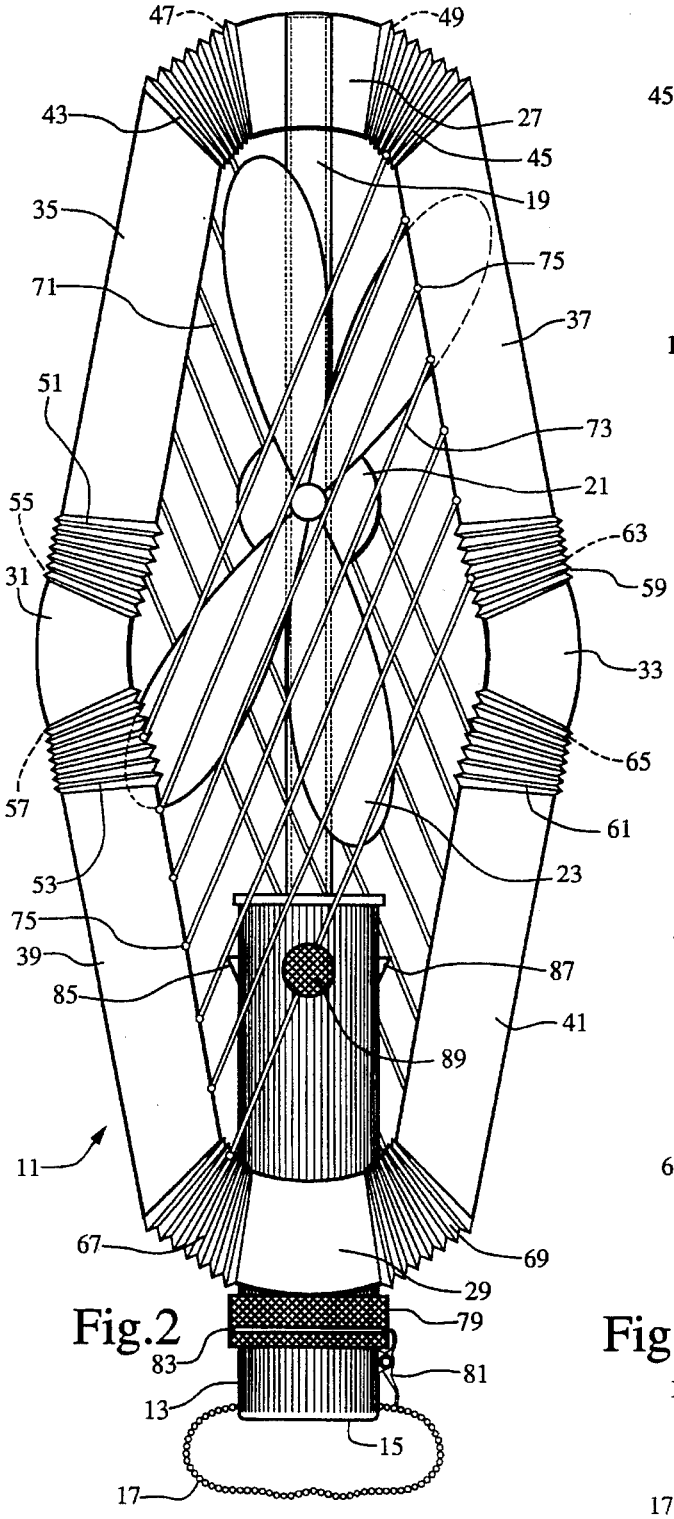
FIG. 2 is a front elevation of a hand-held fan according to the invention, shown in the closed position.
Figure 3:
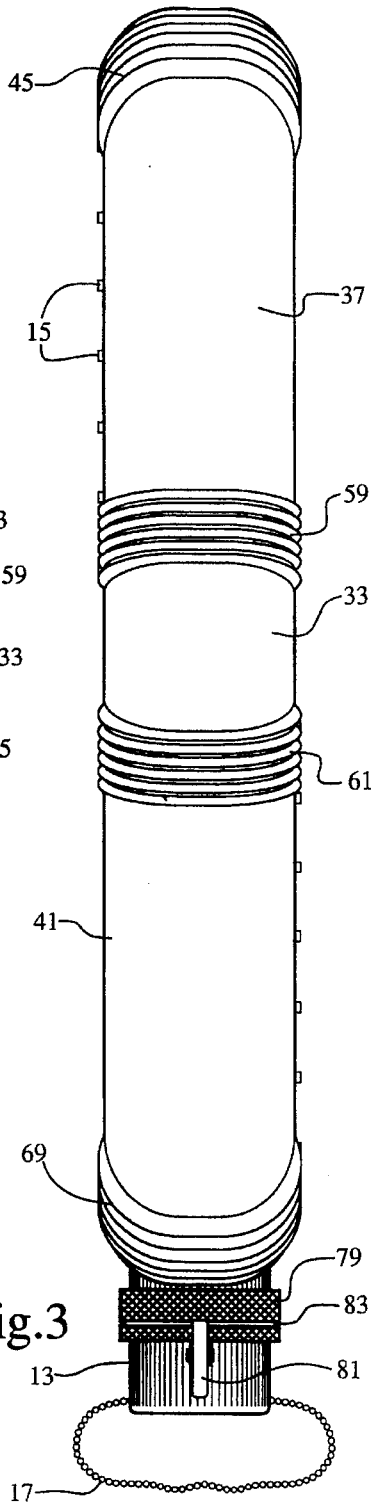
FIG. 3 is a left side elevation of the hand-held fan according to the invention, shown in the closed position.

The electric hand-held fan 11 of the invention has a handle 13, as shown in FIGS. 1–3. The handle 13 is sized to be easily held in a person's hand. A preferred size of the handle 13 would be about one inch (2.5 Centimeters) in diameter, and about three or four inches (seven to ten centimeters)in length. The outer plastic cover of the handle 13 may have a texture, such as grooves, to facilitate gripping the handle 13.

The handle 13 houses a rechargeable battery, like those used in electric screwdrivers, era replaceable battery, like those commonly used in flashlights. The battery may be recharged or replaced by opening the bottom 15 of the handle 13 as shown. Recharging connectors may be optionally added to the handle 13 for connecting to a battery recharging unit and recharging the battery without removing it from the handle 13.

A handle chain 17 may be attached to the handle 13 as shown. The chain 17 may be long enough to wrap around a person's wrist while holding the handle 13. This helps to prevent dropping the fan 11.

A hollow shank 19 extends upward from the upper end of the handle 13. A preferred size of the shank 19 is about one quarter inch (60 millimeters) in outside diameter and one eighth inch (30 millimeters) in inside diameter. The shank 19 is straight and has a preferred length of about seven and a half inches (19 centimeters). A small electric motor 21 is mounted on the shank midway between the handle 13 end of the shank 19 and the upper end of the shank 19. The electric motor is connected to the battery in the handle 13 by electric wires running through the shank 19.

A fan blade 23 is connected to the electric motor 21. In the preferred embodiment, the fan blade 23 has two pairs of blades, held perpendicular to one another, as shown in FIG. 1, by a small spring positioned between the blade 23 and the electric motor 21. The spring is substantially coaxial with the drive shaft of said electric motor 21 and further works in conjunction with a spring biasing aperture on each side of said fan blade 23, and with a pair of limiting notches on each of said fan blades 23. When the fan 11 is closed, the two pairs of blades can folded together, as shown in FIG. 2.

A switch 25 on the handle 13 is used to turn on and off the electric motor 21. In the preferred embodiment, said switch 25 is a suitable push button switch which is recessed into the handle 13. The switch 25 is electrically connected in series with the battery and the electric motor 21, such as is well known in the art. However, it may be desirable that the electric motor 21 be a variable speed motor, and/or that the switch 25 be a variable resistor type switch.

The fan blade 23 is surrounded by a cover assembly consisting of a top corner 27, a bottom corner 29, two side corners 31 and 33, and four sides 35, 37, 39, and 41, connecting the four corners 27, 29, 39, and 41. The four sides 35, 37, 39, and 41 are each substantially a three sided hollow cylinder, including walls which curve in front of and behind the fan blade 23, for defining a conduit in the cover assembly through which the ends of the fan blade 23 may pass.

The top corner 27 is attached to the upper end of the shank 19, and includes three walls which curve downward in front of and behind the shank 19, defining a conduit substantially similar to, and collinear with, that of the four sides 35, 37, 39, and 41. The two upper sides 35 and 37 are connected to the top corner 27 by a pair of bellows 43 and 45, which can fold and unfold as the fan 11 is opened and closed. In addition, a pair of hinges 47 and 49 located on the exterior periphery of the cover assembly relative to the electric motor 21, connect the upper sides 35 and 37 to the top corner 27.

In like manner, the side corner 31 is connected to the sides 35 and 39 by a pair of bellows 51 and 53, and a pair of hinges 55 and 57. Also, the other side corner 33 is connected to the sides 37 and 41 by a pair of bellows 59 and 61 and a pair of hinges 63 and 65.

The bottom corner 29 is connected to the lower sides 39 and 41 by a pair of bellows 67 and 69. There are no hinges between the bottom corner 29 and the sides 39 and 41.

A plurality of cross guards 71 extend between the edge of one of the upper sides 35 to the edge of the opposite lower side 41. These cross guards 71 pass behind the fan blade 23. A similar plurality of cross guards 73 extend between the other upper side 37 to the other lower side 39. These cross guards 73 pass in front of the fan blade 23. The cross guards 71 and 73 thus prevent contact between a person's fingers and the fan blade 23.

Each of the plurality of cross guards 71 and 73 are connected at each end to an edge of the sides 35, 37, 29, and 41 at a connection point 75. Each of the cross guards 71 and 73 can pivot about the connection points 75, but cannot be displaced from the connection points 75. This allows the cross guards 71 and 73 to fold up as the fan is closed.

It is preferred that each of the side corners 31 and 33 contains a damper 77 for slowing the rotation of the fan blade 23 as the fan 11 is closed. Each damper consists of a spongy material and may include several embedded springs for shaping. It is preferred that each end of the dampers has a depth less than that which is found in the mid-section of the damper, for preventing the fan blade 23 from hitting said damper ends, and thereby lending a longer life to said dampers.

The bottom corner 29 has a grip 79 on its lower end. The grip 79 and the rest of the bottom corner 29 encircle the handle 13 and the shank 19. The grip 79 can thus be moved from the open position, shown in FIG. 1, to the closed position, shown in FIGS. 2 and 3.

When the fan 11 is closed, a spring clip 81 on the handle 13 engages an indentation 83 on the grip 79 to hold the fan 11 in the closed position. When the fan 11 is open, the grip 79 is held in place by a pair of spring loaded supports 85 and 87. The supports 85 and 87 must be pushed inward before the grip 79 can pass downward beyond said supports 85 and 87, and the fan 11 be thus closed.

When the fan 11 is closed, a disk-shaped switch guard 89 having a circumference greater than the diameter of the switch 25 covers the switch 25 and prevents movement thereof. The switch guard 89 is attached to, and moves with, one of the cross guards 73.

Figure 4:
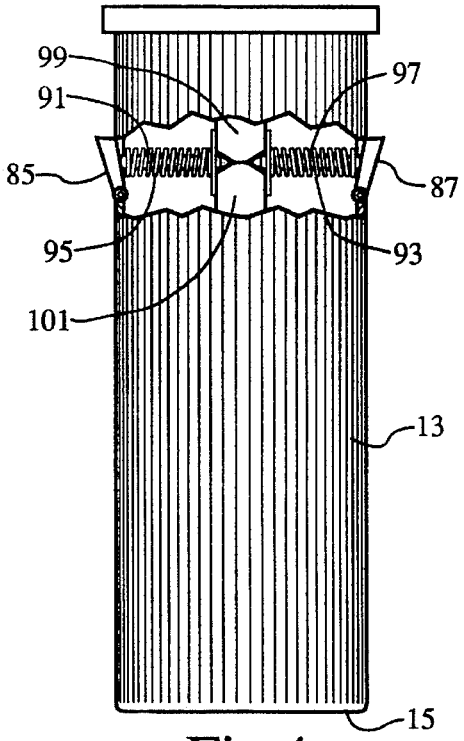
FIG. 4 is a close-up view of the handle of the fan, shown partially in section, with the supports in the open position.
Figure 5:
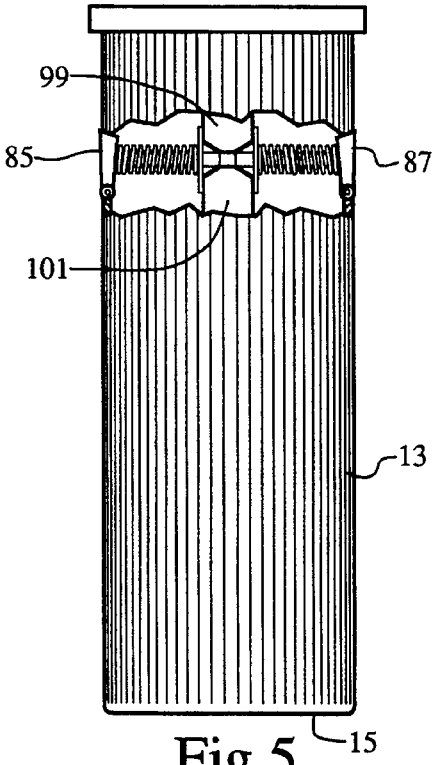
FIG. 5 is a close-up view of the handle of the fan, shown partially in section, with the supports in the inward position.

FIGS. 4 and 5 illustrate another feature of the supports 85 and 87. In the operable mode, the supports 85 and 87 are in the position shown in FIG. 4. The supports 85 and 87 abut a pair of pins 91 and 93, and are biased toward the open position by a pair of springs 95 and 97.

When it is desirable to both turn the fan 11 off and collapse the cover assembly, the supports 85 and 87 are pushed inward to the position shown in FIG. 5, whereby the pins 91 and 93 are forced between a pair of electrical contacts 99 and 101, with which the wires connecting the electric motor 21 to the battery are in electrical communication. The pins 91 and 93 thereby force the contacts 99 and 101 apart, and thus break the electrical circuit between the battery and the motor 21. Therefore, when the supports 85 and 87 are pushed in, the fan 11 is shut off, thereby providing an alternative method of turning off the electric motor 21.

The hand-held electric fan of the present invention has several advantages over the prior art. The cross guards 71 and 73 prevent injury by covering the fan blade 23. The fan 11 is automatically shut off when the fan 11 is closed, thus preventing damage to the fan 11, even if the fan 11 is closed without first turning off the switch 25.

The instant invention has been shown in only one embodiment. It will be apparent to those skilled in the art, however, that the invention is not so limited, but is susceptible to various changes and modifications without departing from the spirit of the invention.

I claim:

1. A hand-held electric fan, comprising:

a handle;

a shank, extending upward from the handle;

an electric motor connected to the shank;

a fan blade attached to the electric motor;

a cover assembly having a top corner, a bottom corner, two side corners, four sides connecting the four corners, and a plurality of cross guards extending from one side to the opposite side in front of the fan blade, wherein the bottom corner of the cover assembly can slide along the handle, so that sliding the bottom corner away from the top corner of the cover assembly draws the side corners inward toward the shank to close the fan, and sliding the bottom corner toward the top corner pushes the side corners outward away from the shank to open the fan.

2. A hand-held electric fan, as recited in claim 1, further comprising a second plurality of across guards extending from one side of the cover assembly to the opposite side of the cover assembly behind the fan blade.

3. A hand-held electric fan, as recited in claim 1, a damper in each of the side corners for slowing the rotation of the fan blade as the fan is closed.

4. A hand-held electric fan, as recited in claim 3, further comprising a second fan blade connected to the electric motor, and movable between an open position perpendicular to the first fan blade and a closed position.

5. A hand-held electric fan, as recited in claim 4, wherein the cross guards can swivel relative to the sides of the cover assembly to which the cross guards are attached.

6. A hand-held electric fan, as recited in claim 5, further comprising a spring-loaded support for securing the cover assembly in the open position, wherein the spring-loaded support must be pushed inward to allow the cover assembly to be closed.

7. A hand-held electric fan, as recited in claim 6, wherein the spring-loaded support shuts off the electric motor when the spring-loaded support is pushed inward.

8. A hand-held electric fan, as recited in claim 7, further comprising:

a switch for turning the fan on and off; and a switch guard for securing the switch when the cover assembly is in the closed position.

9. A hand-held electric fan, as recited in claim 1, further comprising a second fan blade connected to the electric motor, and movable between an open position perpendicular to the first fan blade and a closed position.

10. A hand-held electric fan, as recited in claim 1, wherein the cross guards can swivel relative to the sides of the cover assembly to which the cross guards are attached.

11. A hand-held electric fan, as recited in claim 1, further comprising a spring-loaded support for securing the cover assembly in the open position, wherein the spring-loaded support must be pushed inward to allow the cover assembly to be closed.

12. A hand-held electric fan, as recited in claim 11, wherein the spring-loaded support shuts of the electric motor when the spring-loaded support is pushed inward.

13. A hand-held electric fan, as recited in claim 1, further comprising:

a switch for turning the fan on and off; and a switch guard for securing the switch when the cover assembly is in the closed position.

* * * * *